US009681761B2

(12) United States Patent
Huang

(10) Patent No.: US 9,681,761 B2
(45) Date of Patent: Jun. 20, 2017

(54) SIMPLY STRUCTURED RACK

(71) Applicant: DONGGUAN SAPP PRODUCTS LTD., Dongguan, Guangdong (CN)

(72) Inventor: Shouwan Huang, Guangdong (CN)

(73) Assignee: DONGGUAN SAPP PRODUCTS LTD., Dongguan (CN)

( * ) Notice: Subject to any disclaimer, the term of this patent is extended or adjusted under 35 U.S.C. 154(b) by 0 days.

(21) Appl. No.: 14/247,872

(22) Filed: Apr. 8, 2014

(65) Prior Publication Data

US 2015/0282644 A1 Oct. 8, 2015

(51) Int. Cl.

| | |
|---|---|
| ***A47F 7/28*** | (2006.01) |
| ***A47F 1/12*** | (2006.01) |
| ***A47F 1/00*** | (2006.01) |
| *A47F 5/00* | (2006.01) |

(52) U.S. Cl.

CPC ..... *A47F 7/28* (2013.01); *A47F 1/00* (2013.01); *A47F 1/12* (2013.01); *A47F 5/005* (2013.01); *A47F 5/0025* (2013.01)

(58) Field of Classification Search

CPC .... A47F 1/12; A47F 7/28; A47F 1/125; A47F 1/126; A47F 1/00; A47F 1/04; A47F 1/123; A47F 5/005

See application file for complete search history.

(56) References Cited

U.S. PATENT DOCUMENTS

| | | | | |
|---|---|---|---|---|
| 958,857 | A * | 5/1910 | Dennis | 220/8 |
| 2,079,754 | A * | 5/1937 | Waxgiser | 211/59.3 |
| 2,948,624 | A * | 8/1960 | Watson et al. | 426/111 |
| 3,003,840 | A * | 10/1961 | Katzin | 312/298 |
| 3,501,016 | A * | 3/1970 | Eaton | 211/49.1 |
| 4,300,693 | A * | 11/1981 | Spamer | 211/59.3 |
| 5,016,772 | A * | 5/1991 | Wilk | 220/8 |
| 5,361,895 | A * | 11/1994 | Wilson et al. | 229/101 |
| 6,450,349 | B2 * | 9/2002 | Lee | 211/85.18 |
| 6,502,875 | B1 * | 1/2003 | Berry | 294/27.1 |
| 6,571,498 | B1 * | 6/2003 | Cyrluk | 40/661.03 |
| 7,992,726 | B2 * | 8/2011 | Goehring | 211/59.2 |
| 8,443,988 | B2 * | 5/2013 | Niederhuefner | 211/59.3 |
| 8,844,739 | B2 * | 9/2014 | Holey et al. | 220/4.01 |
| 2006/0283819 | A1 * | 12/2006 | Larsen et al. | 211/59.2 |
| 2011/0174652 | A1 * | 7/2011 | Ito et al. | 206/459.5 |
| 2012/0204458 | A1 * | 8/2012 | Goehring | 40/642.02 |
| 2013/0270205 | A1 * | 10/2013 | Daw | 211/59.3 |
| 2014/0175032 | A1 * | 6/2014 | Chen | 211/49.1 |
| 2014/0367544 | A1 * | 12/2014 | Graves | 248/346.02 |
| 2015/0034576 | A1 * | 2/2015 | Wong | 211/59.3 |

* cited by examiner

*Primary Examiner* — Leslie A Nicholson, III
*Assistant Examiner* — Kimberley S Wright
(74) *Attorney, Agent, or Firm* — Ming Chow; Sinorica, LLC

(57) ABSTRACT

A simply structured rack is disclosed, comprising a rack body formed as a chamber for accommodating bottles and cans, wherein the rack body is formed and surrounded by a first rack plate and a second rack plate, both of which comprise a main plate, a first connection plate and a second connection plate, the two ends of the main plate are curved towards the same side to form the first and the second connection plate, the first connection plate of the first rack plate is connected with the second connection plate of the second rack plate in a sliding manner, and the second connection plate of the first rack plate is connected with the first connection plate of the second rack plate in a sliding manner.

6 Claims, 1 Drawing Sheet

SIMPLY STRUCTURED RACK

FIELD OF THE INVENTION

The present invention relates to the technical field of racks and more specifically to a simply structured rack.

BACKGROUND OF THE INVENTION

With the improved standard of living, living space is required to be utilized more and more intensively. In addition to the refrigerated storage of different kinds of high-end wines, merchants also pay great attention to the utilization of wine display racks which are used not only to visually present different kinds of bottled wines for the customer but also to array the bottled wines intensively on individual display racks in layers to save space and reduce space cost. However, it is difficult to count the total sales of bottled wines merely by checking the empty wine presentation area appearing after the bottled wines on the display rack are sold, especially when the empty wine presentation area is big when the sales volume is great, which is extremely unbeneficial to the management on the presentation of wines, thus, bottle racks are used matching with display racks to improve the efficiency of the management on the quantity of the wines on the display racks. However, existing bottle rack consisting of a plurality of elements is complicated in structure and high in production cost for the reason of a complex processing technology, and the numerous components weight the bottle rack, undermining the portability and the practicability of existing bottle rack, which hinders the market promotion of existing bottle rack, in addition, existing bottle rack cannot be assembled easily, bringing about inconvenience for later repair, and the damage of the main connection fitting of the assembled rack impairs the connection stability of the whole rack and makes the rack hardly usable, thus, the service life of existing rack is short. It is urgent to address all the problems above.

SUMMARY OF THE INVENTION

The purpose of the present invention is to provide a light, portable and cheap simply structured rack which can be produced easily, assembled conveniently and used for a long time to overcome the shortages of existing rack.

The present invention is achieved by the following technical scheme:

a simply structured rack comprises a rack body formed as a chamber for accommodating bottles and cans, wherein the rack body is formed and surrounded by a first rack plate and a second rack plate, both of which comprise a main plate, a first connection plate and a second connection plate, the two ends of the main plate are curved towards the same side to form the first and the second connection plate, the first connection plate of the first rack plate is connected with the second connection plate of the second rack plate in a sliding manner, and the second connection plate of the first rack plate is connected with the first connection plate of the second rack plate in a sliding manner.

A guide block is arranged on the internal surface of the second connection plate of the first rack plate which is away from an end of the main plate, a sliding groove is arranged on the external surface of the first connection plate of the second rack plate matching with the guide block, and the guide block is arranged in the sliding groove in a sliding manner;

the upper edge of the second connection plate of the first rack plate extends towards the chamber and curves downwards to form a first extension sheet, the lower edge of the second connection plate extends towards the chamber and curves upwards to form a second extension sheet, a guide rail is formed and surrounded by the first extension sheet, the second extension sheet and the second connection plate, and the first connection plate of the second rack plate is arranged in the guide rail in a sliding manner.

A guide block is arranged on the internal surface of the end of the second connection plate of the second rack plate which is away from the main plate, a sliding groove is arranged on the external surface of the first connection plate of the first rack plate matching with the guide block, and the guide block is arranged in the sliding groove in a sliding manner;

the upper edge of the second connection plate of the second rack plate extends towards the chamber and curves downwards to form a first extension sheet, the lower edge of the second connection plate extends towards the chamber and curves upwards to form a second extension sheet, a guide rail is formed and surrounded by the first extension sheet, the second extension sheet and the second connection plate, and the first connection plate of the first rack plate is arranged in the guide rail in a sliding manner.

Clamping openings are arranged on two ends of the sliding groove to clamp the guide block.

The guide block is an overhead hook.

A notch is arranged on the external surface of the main plate.

The width of the two end parts of the main plate is smaller than that of the middle part of the main body, and the width of the main plate is gradually increased from the two end parts to the middle part.

The bending parts between the first connection plate and the main plate and between the second connection plate and the main plate are formed into round corners.

The beneficial effects of the present invention lie in that: the rack disclosed herein is simply structured as the rack body is merely formed and surrounded by a first and a second rack plate, needing no other connection fittings, thus simplifying connection fittings, reducing production cost and simplifying production technology to facilitate large-scale production and lightening the rack to make the rack portable and practical, besides, as the accessories of the rack is few, the rack can be maintained easily and used for a long time, which is beneficial to the market promotion of the rack; moreover, as the rack body can be formed by connecting the first rack plate with the second rack plate with a first and a second connection plate, the rack can be assembled conveniently and easily, and the space in the chamber of the rack body can be adjusted conveniently by sliding and extending the first and the second connection plate, thus, the rack provided herein can be used to array different kinds of wine bottles or beverage cans in order and therefore has a wide application range.

The rack provided herein can be used matching with the display rack used in markets to array commodities orderly, in this case, the rack is placed on the display rack and then filled with successive wine bottles; the rack can reflect the reduction in the quantity of each kind of commodities placed on the display rack in time so that commodities can be exchanged or supplied conveniently. The commodities placed in the rack in rows can be taken away and replaced by a new kind commodities by row, thus saving time and facilitating commodity checking; further, when the rack is used with a display rack having an inclined rack plate, a row or column of commodities accommodated in the rack, when taken away, is automatically replaced by the row or column of commodities behind which slide, under the effect of gravity, into the empty position appearing after the commodities are taken away, which facilitates the ordered display of commodities at any time.

DETAILED DESCRIPTION OF THE EMBODIMENTS

The present invention is illustrated below with reference to accompanying drawings.

Embodiment 1

Figure 1:
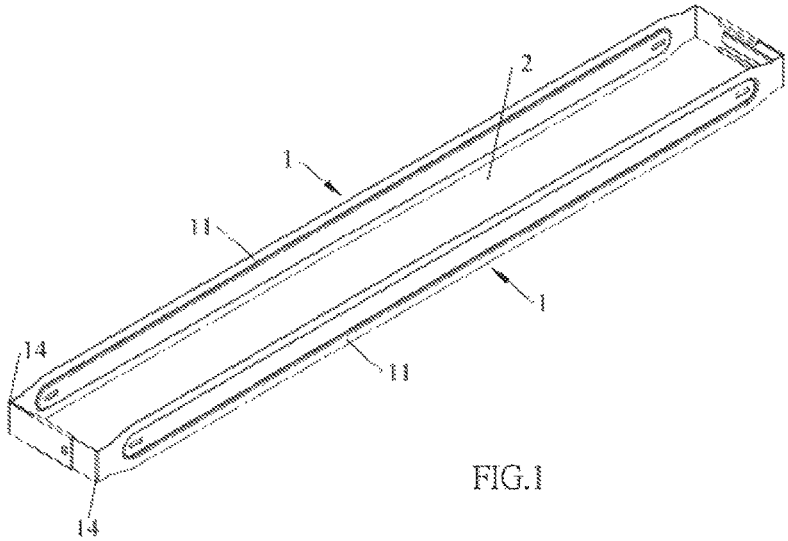
FIG. 1 is schematic diagram illustrating the solid structure of the rack provided herein.
Figure 2:
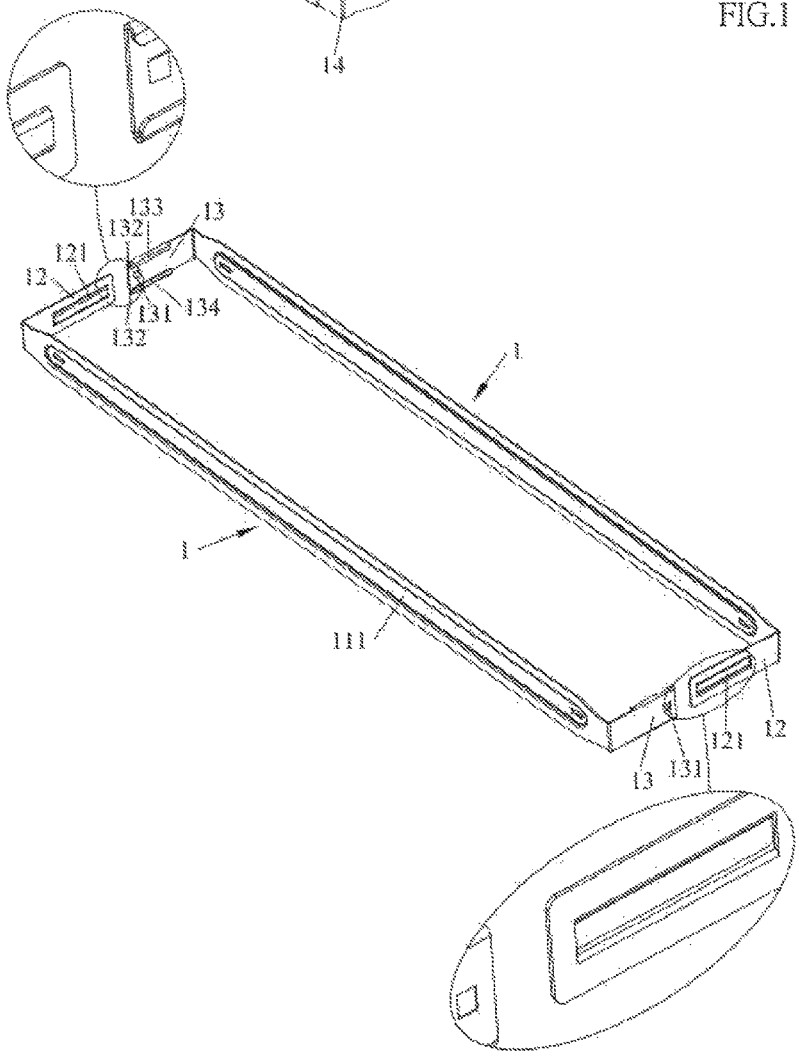
FIG. 2 is schematic diagram illustrating the breakdown structure of the rack provided herein.

As shown in FIG. 1 and FIG. 2, the simply structured rack provided in embodiment 1 comprises rack body 1 formed as a chamber 2 for accommodating bottles and cans, wherein the rack body 1 is formed and surrounded by a first rack plate and a second rack plate, both of which comprise a main plate 11, a first connection plate 12 and a second connection plate 13, the two ends of the main plate 11 are curved towards the same side to form the first and the second connection plate 12 and 13, the first connection plate 12 of the first rack plate is connected with the second connection plate 13 of the second rack plate in a sliding manner, and the second connection plate 13 of the first rack plate is connected with the first connection plate 12 of the second rack plate in a sliding manner.

The rack disclosed herein is simple in structure as the rack body 1 is merely formed and surrounded by the first and the second rack plate, needing no other connection fittings, thus simplifying connection fittings, reducing production cost and simplifying production technology to facilitate large-scale production and lightening the rack to make the rack portable and practical, besides, as the accessories of the rack is few, the rack can be maintained easily and used for a long time, which is beneficial to the market promotion of the rack; moreover, as the rack body 1 can be formed by connecting the first rack plate with the second rack plate with the first and the second connection plate 12 and 13, the rack can be assembled conveniently and easily, and as the space in the chamber 2 of the rack body 1 can be adjusted conveniently by sliding and extending the first and the second connection plates 12 and 13, the rack provided herein can be used to array different kinds of wine bottles or beverage cans in order and therefore has a wide application range The rack provided herein can be used matching with the display rack used in markets to array commodities orderly, in this case, the rack is placed on the display rack and then filled with successive wine bottles, the rack can reflect the reduction in the quantity of each kind of commodities placed on the display rack in time so that commodities can be exchanged or supplied conveniently. The commodities placed in the rack in rows can be taken away and replaced by a new kind commodities by row, thus saving time and facilitating commodity checking; further, when the rack is used with a display rack having an inclined rack plate, a row or column of commodities accommodated in the rack, when taken away, is automatically replaced by the row or column of commodities behind which slide, under the effect of gravity, into the empty position appearing after the commodities are taken away, which facilitates the ordered display of commodities at any time.

In the embodiment, a guide block 131 is arranged on the internal surface of the second connection plate 13 of the first rack plate which is away from an end of the main plate 11, a sliding groove 121 is arranged on the external surface of the first connection plate 12 of the second rack plate matching with the guide block 131, and the guide block 131 is arranged in the sliding groove 121 in a sliding manner. The guide block 131 cooperates with the sliding groove 121 in a sliding manner to guide the relative sliding of the first connection plate 12 and the second connection plate 13 to smooth the sliding of the first connection plate 12 and the second connection plate 13, additionally, the guide block 131 has a position limiting effect for the sliding groove 121, thus preventing the sliding of the second connection plate 13 off the first connection plate 12.

The upper edge of the second connection plate 13 of the first rack plate extends towards the chamber 2 and curves downwards to form a first extension sheet 133, the lower edge of the second connection plate 13 extends towards the chamber 2 and curves upwards to form a second extension sheet 134, a guide rail 132 is formed and surrounded by the first extension sheet 133, the second extension sheet 134 and the second connection plate 13, and the first connection plate 12 of the second rack plate is arranged in the guide rail 132 in a sliding manner. The first extension sheet 133, the second extension sheet 134 and the second connection plate 13 are integrally formed and are therefore stable in structure, the first connection plate 12, when sliding in the guide rail 132, is stably clamped among the first extension sheet 133, the second extension sheet 134 and the second connection plate 13, the replacement of a connector by the guide rail 132 not only guides the sliding of the first connection plate 12 but also limits the position of the first connection plate 12, thus preventing the first connection plate 12 from separating from the second connection plate 13 during a relative sliding process.

In the embodiment, a guide block 131 is arranged on the internal surface of the second connection plate 13 of the second rack plate which is away from an end of the main plate 11, a sliding groove 121 is arranged on the external surface of the first connection plate 12 of the first rack plate matching with the guide block 131, and the guide block 131 is arranged in the sliding groove 121 in a sliding manner. The guide block 131 cooperates with the sliding groove 121 in a sliding manner to guide the relative sliding of the first connection plate 12 and the second connection plate 13 to smooth the sliding of the first connection plate 12 and the second connection plate 13, additionally, the guide block 131 has a position limiting effect for the sliding groove 121, thus preventing the sliding of the second connection plate 13 off the first connection plate 12.

The upper edge of the second connection plate 13 of the second rack plate extends towards the chamber 2 and curves downwards to form a first extension sheet 133, the lower edge of the second connection plate 13 extends towards the chamber 2 and curves upwards to form a second extension sheet 134, a guide rail 132 is formed and surrounded by the first extension sheet 133, the second extension sheet 134 and the second connection plate 13, and the first connection plate 12 of the first rack plate is arranged in the guide rail 132 in a sliding manner. The first extension sheet 133, the second extension sheet 134 and the second connection plate 13 are integrally formed and are therefore stable in structure, the first connection plate 12, when sliding in the guide rail 132, is stably clamped among the first extension sheet 133, the second extension sheet 134 and the second connection plate 13, the replacement of a connector by the guide rail 132 not only guides the sliding of the first connection plate 12 but also limits the position of the first connection plate 12, thus preventing the first connection plate 12 from separating from the second connection plate 13 during a relative sliding process.

In the embodiment, the guide block 131 is an overhead hook which can be reversely hooked on an end part of the sliding groove 121 to be prevented from being loosed and therefore has a high structural stability.

Embodiment 2

Embodiment 2 is different from embodiment 1 in that a notch 111 is arranged on the external surface of the main plate 11. To save the space of a display rack, the rack provided herein, when in use, is placed on the display rack tightly close to another one, when the rack is pulled out, the notch 111 on the main plate 11 recesses the main plate 11 to avoid the direct contact of the surfaces of the main plates 11 of each two adjacent racks, thus reducing frictional resistance to make it more convenient to take away the rack and avoiding the large-area friction of main plates 11 to reduce abrasion to make contributions to maintenance and a long-term use.

In the embodiment, clamping openings for clamping the guide block 131 are arranged on two ends of the sliding groove 121. When the guide block 131 slides to the end part of the sliding groove 121, the guide block 131 is reversely clamped in the clamping opening which is capable of limiting the sliding of the guide block 131 on the end part of the sliding groove 121 to avoid the sliding of the first connection plate 12 and the second connection plate 13 off each other caused by the pass of the guide block 131 over the sliding groove 121 and stabilizes the connection.

Embodiment 3

Embodiment 3 is different from embodiment 1 in that the width of the two end parts of the main plate 11 is smaller than that of the middle part of the main body 11, and the width of the main plate 11 is gradually increased from the two end parts to the middle part. When the rack is placed on a horizontal plane, as the width of the end parts of the main plate 11 is smaller, a certain gap is formed between the end parts of the main plate 11 and the horizontal plate for the user to put a hand into the gap to hold the rack conveniently, besides, the formation of the gap makes the rack more beautiful.

In embodiment 3, round corners 14 are formed at the bending parts between the first connection plate 12 and the main plate 11 and between the second connection plate 13 and the main plate 11. The round corners 14 round the corners of the rack and prevent the hand of the user from being injured, thus, the rack is safer to use.

Other components of embodiment 3 are the same as those of embodiment 1 and are therefore not described repeatedly.

The aforementioned embodiments are merely preferred embodiments of the present invention are not to be construed as limiting the implementation scope of the present invention, and all the equivalent variations or modifications devised based on the configuration, features and principle of the present invention should fall into the protection scope of the present invention.

What is claimed is:

1. A simply structured rack, comprising:

a rack body formed as a chamber for accommodating bottles and cans, wherein the rack body is formed and surrounded by a first rack plate and a second rack plate, both of which comprise a main plate, a first connection plate and a second connection plate, the two ends of the main plate are curved towards the same side to form the first and the second connection plate, the first connection plate of the first rack plate is connected with the second connection plate of the second rack plate in a sliding manner, and the second connection plate of the first rack plate is connected with the first connection plate of the second rack plate in a sliding manner;

a guide block being arranged on the internal surface of the second connection plate of the first rack plate which is away from an end of the main plate, a sliding groove being arranged on the external surface of the first connection plate of the second rack plate matching with the guide block, the guide block being arranged in the sliding groove in a sliding manner;

the upper edge of the second connection plate of the first rack plate extending towards the chamber and curving downwards to form a first extension sheet, the lower edge of the second connection plate extending towards the chamber and curving upwards to form a second extension sheet, a guide rail being formed and surrounded by the first extension sheet, the second extension sheet and the second connection plate, and the first connection plate of the second rack plate being arranged in the guide rail in a sliding manner;

clamping openings being arranged on two ends of the sliding groove to clamp the guide block.

2. The simply structured rack according to claim 1, wherein a guide block is arranged on the internal surface of the second connection plate of the second rack plate which is away from an end of the main plate, a sliding groove is arranged on the external surface of the first connection plate of the first rack plate matching with the guide block, the guide block is arranged in the sliding groove in a sliding manner;

the upper edge of the second connection plate of the second rack plate extends towards the chamber and curves downwards to form a first extension sheet, the lower edge of the second connection plate extends towards the chamber and curves upwards to form a second extension sheet, a guide rail is formed and surrounded by the first extension sheet, the second extension sheet and the second connection plate, and the first connection plate of the first rack plate is arranged in the guide rail in a sliding manner.

3. The simply structured rack according to claim 1, wherein the guide block is an overhead hook.

4. The simply structured rack according to claim 1, wherein a notch is arranged on the external surface of the main plate.

5. The simply structured rack according to claim 1, wherein the width of the two end parts of the main plate is smaller than that of the middle part of the main body, and the width of the main plate is gradually increased from the two end parts to the middle part.

6. The simply structured rack according to claim 1, wherein the bending parts between the first connection plate and the main plate and between the second connection plate and the main plate are formed into round corners.

* * * * *